US008474892B1

(12) United States Patent
Hanna

(10) Patent No.: US 8,474,892 B1
(45) Date of Patent: Jul. 2, 2013

(54) LIFTING APPARATUS AND METHOD

(75) Inventor: Matthew Hanna, Brashear, TX (US)

(73) Assignee: Pinnacle Companies, Inc., Sulphur Springs, TX (US)

( * ) Notice: Subject to any disclaimer, the term of this patent is extended or adjusted under 35 U.S.C. 154(b) by 0 days.

(21) Appl. No.: 13/495,818

(22) Filed: Jun. 13, 2012

(51) Int. Cl.
*B66C 1/66* (2006.01)

(52) U.S. Cl.
USPC ..... 294/68.3; 294/86.41

(58) Field of Classification Search
USPC ..... 414/723, 406, 408; 37/468; 294/68.3, 294/67.32, 86.41, 92
See application file for complete search history.

(56) References Cited

U.S. PATENT DOCUMENTS

| | | | | |
|---|---|---|---|---|
| 235,311 | A | 12/1880 | Stephenson | |
| 289,726 | A | 12/1883 | Tevis | |
| 869,210 | A | 10/1907 | Martin et al. | |
| 1,651,317 | A | 11/1927 | Bell | |
| 1,713,730 | A | 5/1929 | Wright | |
| 1,915,757 | A | 6/1933 | Pierce | |
| 2,243,723 | A | 5/1941 | Tench | |
| 2,329,678 | A | 9/1943 | Pennington | |
| 2,371,902 | A | 3/1945 | Long | |
| 2,384,939 | A | 9/1945 | Lord | |
| 2,527,653 | A | 10/1950 | Pierce | |
| 2,567,164 | A | 9/1951 | Brehany et al. | |
| 2,726,123 | A | 12/1955 | Matthews | |
| 2,727,286 | A | 12/1955 | Moore | |
| 2,904,126 | A | 9/1959 | Meng et al. | |
| 3,084,638 | A | 4/1963 | Allegrette | |
| 3,225,362 | A | 12/1965 | Barrera | |
| 3,262,517 | A | 7/1966 | Malec | |
| 3,489,320 | A | 1/1970 | MacKinnon | |
| 3,490,558 | A | 1/1970 | Foley | |
| 3,510,142 | A | 5/1970 | Erke | |
| 3,718,222 | A * | 2/1973 | Foster | 414/723 |
| 3,726,431 | A | 4/1973 | Botkin | |

(Continued)

FOREIGN PATENT DOCUMENTS

| | | | |
|---|---|---|---|
| DE | 3320969 | A1 | 12/1984 |
| EP | 0937606 | A2 | 8/1999 |

(Continued)

OTHER PUBLICATIONS

Connecting Catwalk Corrugated Wall Liquid Storage Brochure, Dragon Products LTD.

(Continued)

*Primary Examiner* — Dean Kramer
(74) *Attorney, Agent, or Firm* — Carstens & Cahoon, LLP; Vincent J. Allen

(57) ABSTRACT

There is provided an assembly for hoisting and transporting objects having support receptacles affixed to its outer surface and for moving the objects into a desired close alignment in a predetermined location. The assembly includes a mounting bracket configured to mechanically engage with a lifting end of a crane and at least a pair of lifting plates pivotally coupled to the mounting bracket. The lifting plates have opposed non-parallel sides that are angled to engage the support receptacles during lifting of the object and during transportation of the object. When the crane moves the object to its desired location, the crane operator may pivot the assembly to facilitate aligning the object. Upon completion of alignment, the object is put down, and the lifting plates disengage from the support receptacles by sliding out of the slots of the support receptacles.

19 Claims, 5 Drawing Sheets

U.S. PATENT DOCUMENTS 3,793,178 A 2/1974 Austin et al.
3,884,373 A 5/1975 Archibald
3,997,024 A 12/1976 Fredricks et al.
4,018,354 A 4/1977 Lawler
4,068,777 A 1/1978 Humphrey et al.
4,106,423 A 8/1978 Glasfeld et al.
4,108,326 A 8/1978 Bertolini
D253,051 S 10/1979 Pletcher
4,171,550 A 10/1979 Phaup
4,230,048 A 10/1980 Gordon et al.
4,244,523 A 1/1981 Looper
4,258,953 A 3/1981 Johnson
4,318,549 A 3/1982 Pletcher
4,351,478 A 9/1982 Looper
4,406,471 A 9/1983 Holloway
4,422,485 A 12/1983 O'Shea et al.
4,545,720 A * 10/1985 Cochran et al. ..... 414/723
4,572,328 A 2/1986 Benko
4,589,565 A 5/1986 Spivey
4,613,053 A 9/1986 Kimura et al.
4,613,271 A * 9/1986 Naab ..... 414/303
4,718,353 A 1/1988 Schuller et al.
4,722,658 A * 2/1988 Wurtz et al. ..... 414/408
4,787,111 A 11/1988 Pacek et al.
D301,326 S 5/1989 Adams
4,874,184 A 10/1989 Boyer
5,004,269 A 4/1991 Pelt
D318,033 S 7/1991 Pelt
5,033,637 A 7/1991 Webb
5,054,635 A 10/1991 Kolom
5,058,924 A 10/1991 Whatley, Jr.
5,122,025 A 6/1992 Glomski
5,165,835 A * 11/1992 Schafer ..... 414/406
5,169,195 A * 12/1992 Kirchhoff ..... 294/68.26
5,213,367 A 5/1993 Norman, Jr. et al.
5,220,933 A 6/1993 Albers
5,273,180 A 12/1993 Whatley, Jr.
5,294,016 A 3/1994 Crenshaw
5,301,980 A 4/1994 Dingle
D348,304 S 6/1994 Norman, Jr. et al.
5,346,093 A 9/1994 De Benedittis et al.
D353,352 S 12/1994 Holloway, Jr.
5,538,286 A 7/1996 Hoff
D375,470 S 11/1996 Adams
5,607,133 A 3/1997 Markham et al.
D378,810 S 4/1997 Norman, Jr. et al.
D379,948 S 6/1997 Wade
5,653,469 A 8/1997 Wade
5,671,855 A 9/1997 Norman, Jr. et al.
D384,913 S 10/1997 Norman, Jr. et al.
5,676,460 A 10/1997 Biberstine et al.
5,678,978 A 10/1997 Markham
5,718,382 A 2/1998 Jaeger
5,743,191 A 4/1998 Coslovi
5,816,423 A 10/1998 Fenton et al.
5,957,500 A 9/1999 Wade
D417,171 S 11/1999 Satterfield et al.
5,979,335 A 11/1999 Saxton et al.
6,045,157 A 4/2000 Poulin
6,098,744 A 8/2000 Kawamura
6,152,492 A 11/2000 Markham et al.
6,173,991 B1 1/2001 Piona et al.
6,176,279 B1 1/2001 Dahlin et al.
6,199,910 B1 3/2001 Wade
D441,692 S 5/2001 Niblett et al.
6,279,955 B1 8/2001 Fisher
6,354,787 B1 3/2002 O'Daniel
6,375,222 B1 4/2002 Wade
6,390,325 B1 5/2002 Gonzales
6,431,093 B1 8/2002 Hansen
6,645,016 B1 11/2003 Andersen et al.
6,659,225 B2 12/2003 Olliges et al.
6,672,467 B2 * 1/2004 Merkel et al. ..... 212/168
6,761,414 B1 7/2004 Broberg
6,793,178 B2 9/2004 Peterson
6,799,975 B1 10/2004 Dunn
6,957,806 B2 10/2005 Tubbs
7,080,806 B2 7/2006 Mills
7,228,936 B2 6/2007 Wyse et al.
7,244,123 B1 7/2007 Barron
7,300,073 B2 11/2007 Bachman
D557,178 S 12/2007 Petzitillo, Jr. et al.
7,387,316 B2 6/2008 Keiser
7,413,377 B2 8/2008 Pontano, III
7,448,586 B2 11/2008 Ziaylek et al.
7,472,663 B1 1/2009 Horn
7,478,490 B2 * 1/2009 Segerljung ..... 37/468
7,503,535 B2 3/2009 Ziaylek
7,624,843 B2 12/2009 Cresswell
7,762,588 B2 7/2010 Markham
7,815,222 B2 10/2010 Markham
7,900,936 B2 3/2011 Imai
7,997,441 B2 8/2011 Marcel
8,365,937 B2 2/2013 Lovelace et al.
8,376,167 B2 2/2013 Lovelace et al.
2003/0020253 A1 1/2003 Bosman et al.
2005/0115621 A1 6/2005 Van Vliet et al.
2007/0280810 A1 * 12/2007 Lougheed et al. ..... 414/723
2008/0251322 A1 10/2008 Irvin
2009/0090581 A1 4/2009 Kennedy
2010/0013206 A1 1/2010 Markham
2010/0032435 A1 2/2010 Satterfield et al.
2011/0265685 A1 11/2011 Swygert

FOREIGN PATENT DOCUMENTS

FR 2595999 A1 9/1987
FR 2655172 A1 5/1991
FR 2670453 A1 6/1992
JP 9240359 A 9/1997

OTHER PUBLICATIONS 10,000 to 21,000 Gal Frac Tanks Brochure, Dragon Products LTD.

* cited by examiner

LIFTING APPARATUS AND METHOD

BACKGROUND OF INVENTION

1. Technical Field

The technology relates to the field of fluid storage tanks, and more particularly to the fabrication of large above-ground liquid storage tanks that can be used to contain brine, for example, in connection with oil and gas production.

2. Description of the Related Art

There has been an increasing demand for energy worldwide. As a result, many different technologies are being used to meet this demand, and many are under development. Current technologies include, for example, traditional oil and gas production, secondary and enhanced oil and gas recovery techniques, coal production, use of solar panels and wind turbines to generate electricity, production of bio-fuels, use of ocean waves to generate electricity, and the use of nuclear reactors to generate electricity. It is known that in several parts of the world there are large subterranean reservoirs of natural gas, a desirable clean burning fuel, held in relatively impermeable geological formations. The relative impermeability of these formations presents a challenge to the production of these gas reserves because the gas is "tightly held" within the formations and cannot readily flow to a production well.

The technique of hydraulic fracturing of impermeable subterranean formations is being used to produce gas from relatively impermeable formations. Hydraulic fracturing, also known as "fracking" or "hydro-fracking," is a technology that fractures underground formations creating flow pathways for release of the trapped natural gas and production of that gas for commercial purposes.

During gas production, "brine" containing injected chemicals is produced. This brine must be disposed of in an environmentally acceptable manner. In addition, the fracking operation typically consumes large amounts of water for hydraulic fracturing of the formations. So, before fracking there is a need for short term storage of the hydro-fracking fluid, and after fracking there is a need to store the brine produced.

Brine may be stored above ground in storage tanks for a period of time. There are several different tank designs. However, they should preferably meet criteria of durability and resistance to leaks under the conditions of use, and should be relatively easy and inexpensive to transport and construct. In the case of some tank designs, for example circular tanks, that are made up of a series of interlocked curved wall sections, there are significant challenges on site in handling the heavy metal sections. Each wall section is hoisted by a crane and guided into place next to other already installed wall sections. In order to get a closer alignment between the wall sections to facilitate joining wall sections together, workers must manipulate the wall section into position. The use of manpower in proximity to heavy wall sections, and man-handling the wall sections, poses an issue of potential risk to the worker. In addition, the use of additional manpower to guide the wall sections into position of closer alignment incurs labor costs.

SUMMARY OF PREFERRED EMBODIMENT

The following is a summary of some aspects and exemplary embodiments of the present technology, of which a more detailed explanation is provided under the Detailed Description section, here below.

An exemplary embodiment provides an assembly for hoisting sections of a tank wall into position during above ground tank construction. The tank wall sections are equipped with support receptacles that may be affixed temporarily or permanently to the curved outer surface of the tank wall section. The exemplary embodiment provides an assembly that includes a mounting bracket configured to mechanically engage with a lifting end of a crane. It also has lifting plates pivotally coupled to the mounting bracket. The lifting plates have opposed non-parallel sides that are configured to engage the support receptacles to thereby lift the tank wall section to which they are attached. The lifted tank wall section is transported for installation into the tank wall being constructed or repaired. To align the tank wall section more precisely and appropriately with an already-installed tank section to which it will be coupled, the assembly controllably pivots the lifting plates, about a pivot point, relative to the mounting bracket. This pivots the tank wall section into the desired position. Upon completion, the lifting plates disengage from the support receptacles by sliding away from the support receptacles, leaving the tank wall section in place.

Another exemplary embodiment provides a method of using an assembly for installing a tank wall section into a tank wall. The tank wall section has support receptacles attached to its outer surface. The pivoting assembly is attached to a lifting end of a crane. The exemplary method includes the steps of engaging a support receptacle with each of the lifting plates of the assembly, and lifting the tank wall section with the crane; moving the wall section to the desired location; and aligning the tank wall section by controllably pivoting the assembly by pivoting the lifting plates. Once the alignment is achieved, the lifting plates are disengaged from the support receptacles by sliding the lifting plates away from the support receptacles.

BRIEF DESCRIPTION OF THE DRAWINGS

Various embodiments will be described in conjunction with the following drawings which are schematic, not to scale, and wherein like numerals denote like elements, and.

DETAILED DESCRIPTION

The following detailed description is exemplary in nature facilitating an understanding of the inventions embodied in the appended patent claims. This detailed description is not intended to, and does not, limit the inventions to the described exemplary embodiments, or the application and uses of the exemplary embodiments. Furthermore, there is no intention to be bound by any express or implied theory presented in the preceding background, summary or the following detailed description.

Above ground tanks may contain thousands of gallons of liquid, such as fracking fluids and brine. These tanks generally have a metal circular outer wall with an inner liner enclosing the volume of liquid. The tank walls are subjected to radially outward directed forces from the pressure of the mass of liquid, which varies based on the height of liquid within the tank and the liquid's density. These walls are therefore strong and heavy and pose challenges when lifted into place at the tank site. Generally, the wall sections are fabricated off site and lifted by a hoist or crane onto a truck bed and transported to the tank site. At the site, they are individually lifted by a hoist or crane and guided into place with assistance of manual labor. Mechanization and automation of this process at the tank site would reduce the labor required and potentially improve safety.

Figure 1:
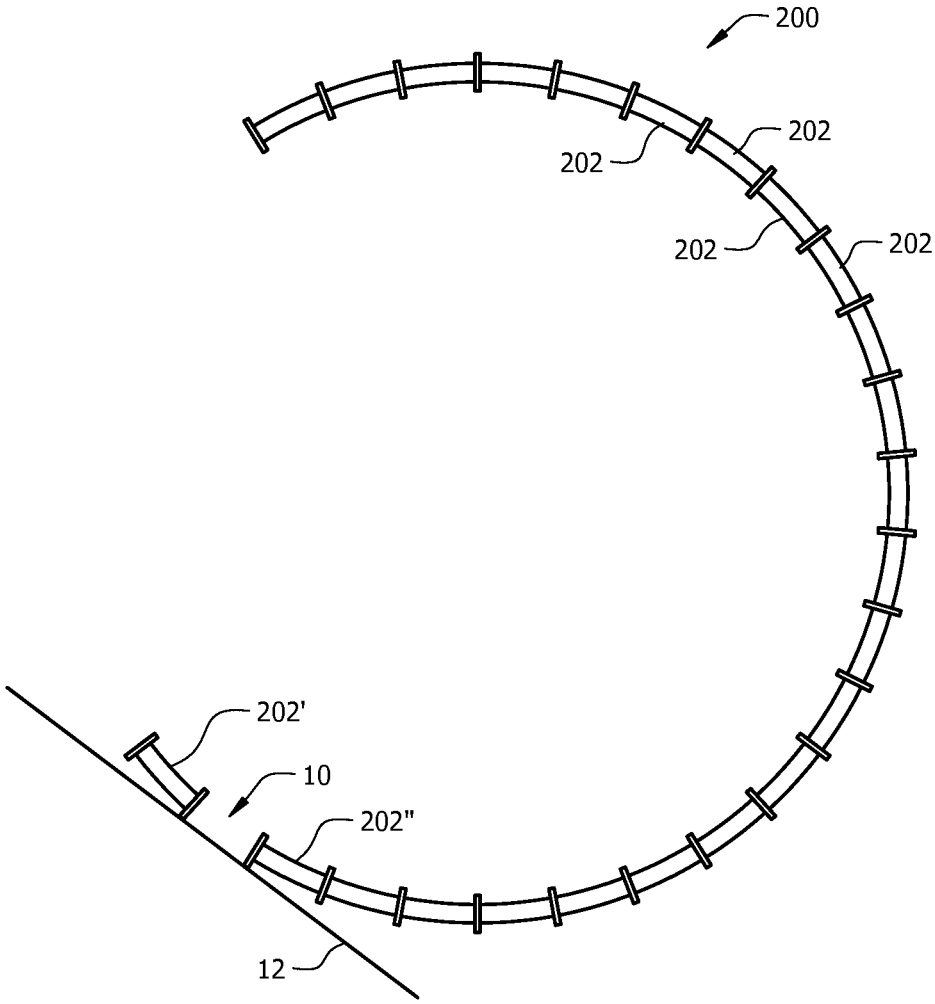
FIG. 1 is a schematic diagram showing a top view of a curved wall section of a storage tank under construction and indicating the alignment of the wall section relative to the installed wall section.
Figure 2:
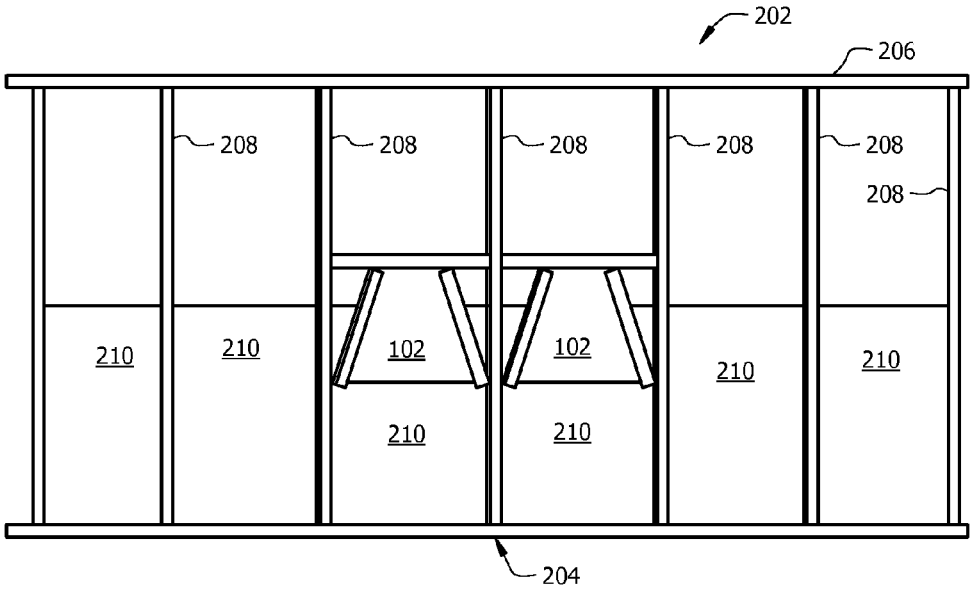
FIG. 2 is a schematic illustration of a side view portion of a wall of a storage tank showing the support receptacles used to the lift tank wall section into position.

Referring to the exemplary embodiments illustrated at FIGS. 1 (a partial top view) and 2 (a partial side view), the tank wall 200 is constructed of a series of curved sections 202 that are joined together, end to end. As seen in FIG. 2, each curved section 202 of the tank wall 200, in this example, has a structure that includes a curved (circular in this exemplary case for a round tank) top beam 206 and likewise curved bottom beam 204, with vertical supports 208 at spaced intervals between the top and bottom beams. Spaces 210 between the supports 208 are metal plate, covered with thick plastic sheeting on the other side, for example, to contain the liquid inside the tank.

As seen in FIG. 2, according to an exemplary embodiment, trapezoidal support receptacles 102 are affixed on the outer surface of the tank wall section 202. These support receptacles 102 are used to lift the tank wall section for transport at the site and for placing the tank wall section in position for constructing (or repairing) the tank wall. However, while these support receptacles facilitate lifting of the tank wall sections, close alignment of the heavy tank wall section to facilitate mechanical coupling to the end of the wall section to which it much be attached, still poses challenges, and requires manual labor.

The alignment issue is illustrated in FIG. 1, where it is desired to align a new tank wall section 202" closely with end tank wall section 202". To achieve this closeness and alignment, the gap 10 between the tank section ends has to be closed, and in addition, the tank section ends adjacent to each other should lie on common tangent line 12 to the tank wall surface at the point of connection of sections 202' and 202".

Exemplary embodiments, therefore, also provide a pivot capability: the assembly is able to pivot and the crane operator is thereby able to visually align the tank wall section on the assembly before setting it down in close alignment with the tank wall end to which it is intended to be attached. Without thus pivoting capability, the hoist carrying the tank wall section would have to be repositioned, perhaps several times, before the tank wall section is aligned with the adjacent section for attachement.

Exemplary embodiments provide a lifting assembly that has a fixed relation to the crane to which it is attached, but that can swivel under operator control to more precisely align the tank wall section with the adjacent already-installed the wall section, for ease of construction. This reduces or eliminates the need for manual labor manipulation of heavy tank wall sections, with all potential attendant risks, to facilitate installation.

Figure 3:
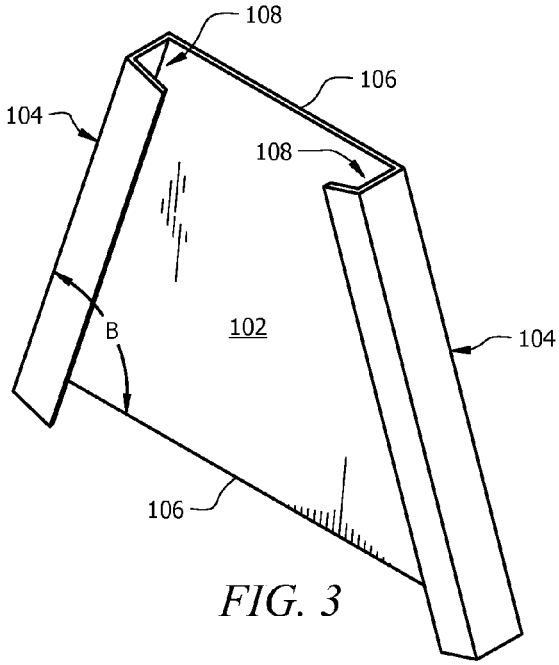
FIG. 3 is a perspective view of an exemplary embodiment of a support receptacle to be lifted and placed in position by a pivoting assembly for hoisting objects to be lifted via attached support receptacles.

An exemplary embodiment of a support receptacle is illustrated in FIG. 3. In this example, the support receptacle 102 is trapezoidal, having parallel upper and lower sides 106 and non-parallel or converging sides 104. The ends of non-parallel sides 104 are folded to provide slots 108 that are sized to engage lifting plates of an assembly 100 for hoisting the support receptacles and any object to which they are attached, as explained in more detail below. Of course, support receptacles are not limited to trapezoidal shapes, but can include triangular shapes, and indeed, any shape that will allow the lifting plate of the assembly (1) to slidingly and securely engage slots of the support receptacle and prevent the support receptacle from falling off under gravity, and (2) to disengage by sliding out of the slots, when the tank wall section is set down in place aligned with the adjacent installed section of the tank wall.

Figure 4A:
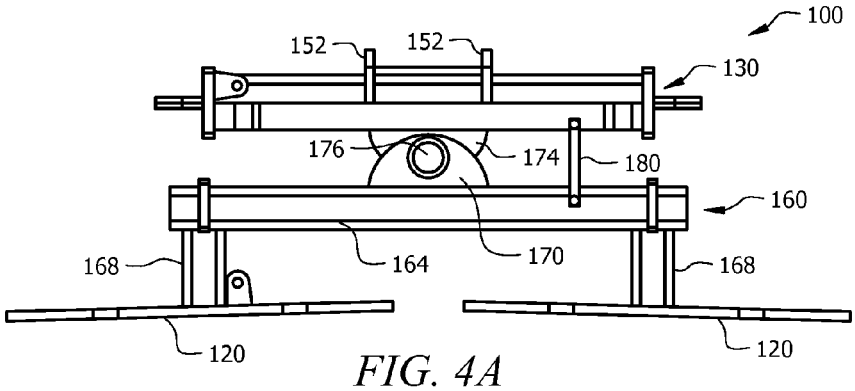
FIGS. 4A, 4B and 4C are top views of an exemplary embodiment of the lifting assembly for hoisting support receptacles showing neutral and pivot positions.
Figure 5A:
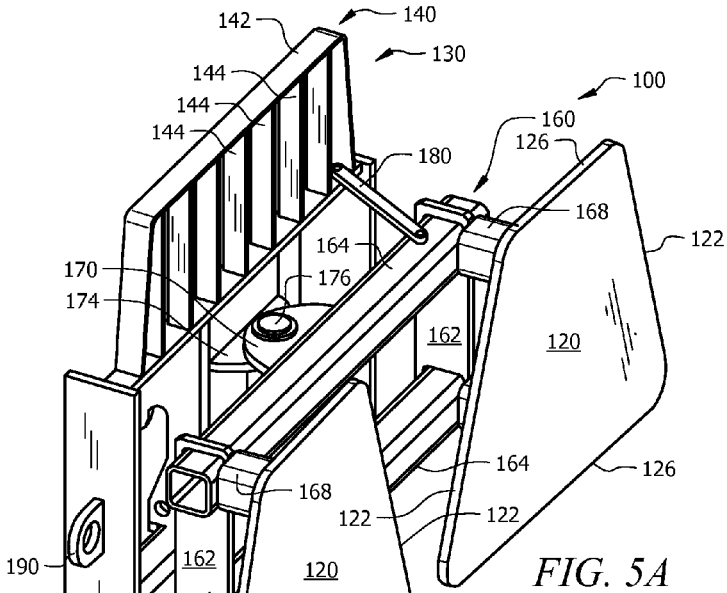
FIGS. 5A, 5B and 5C are perspective views of an exemplary embodiment of the lifting assembly for hoisting support receptacles of FIGS. 4 A, B and C.
Figure 5B:
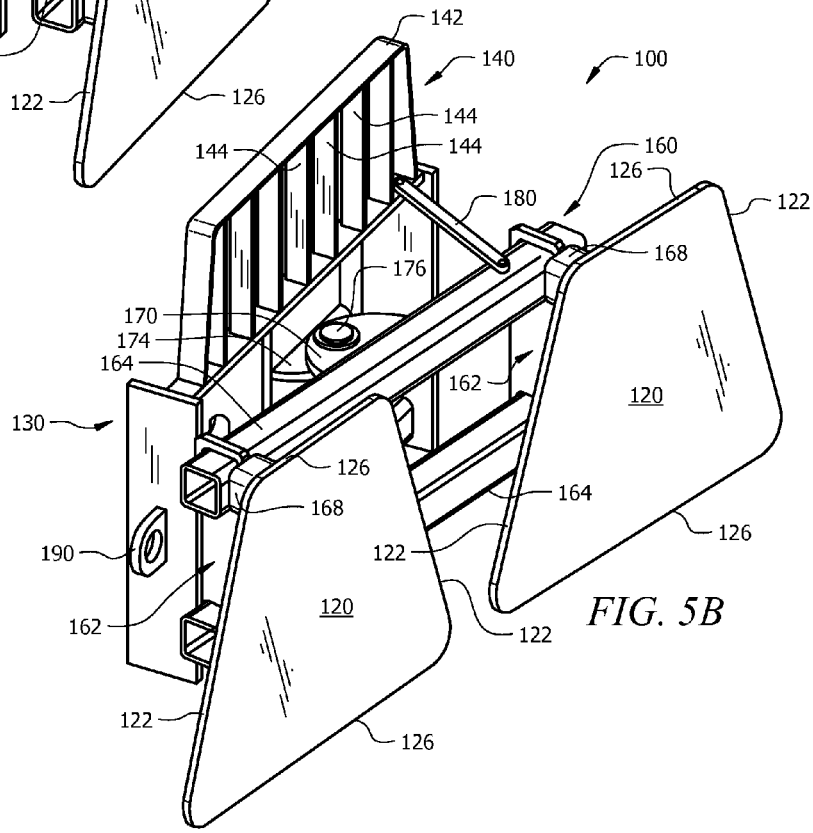
Figure 5C:
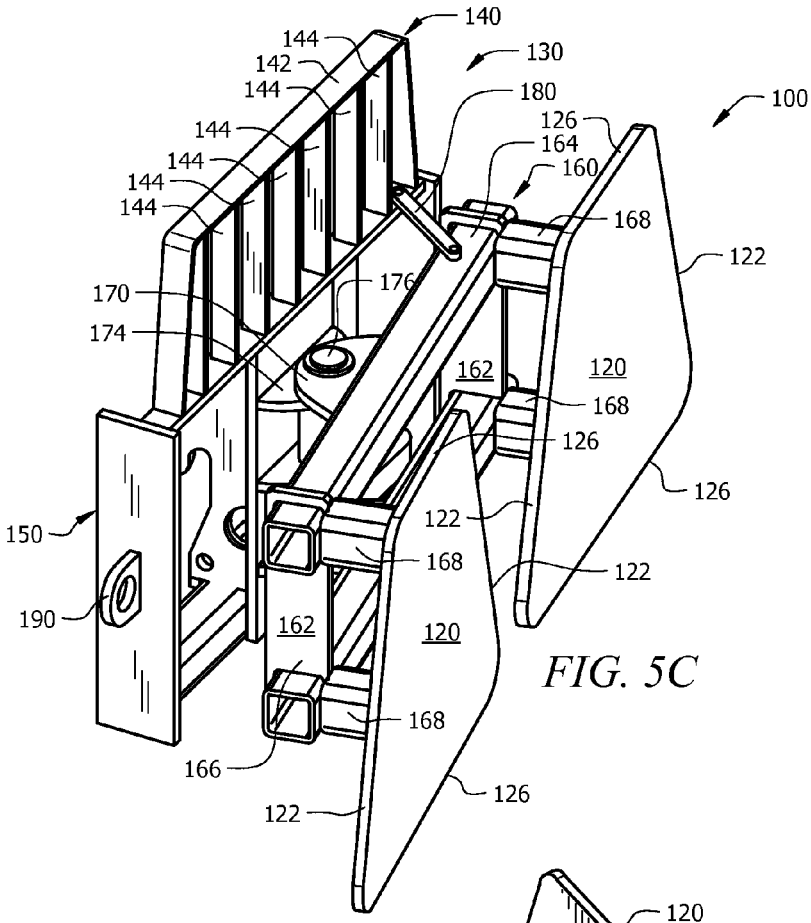
Figure 6:
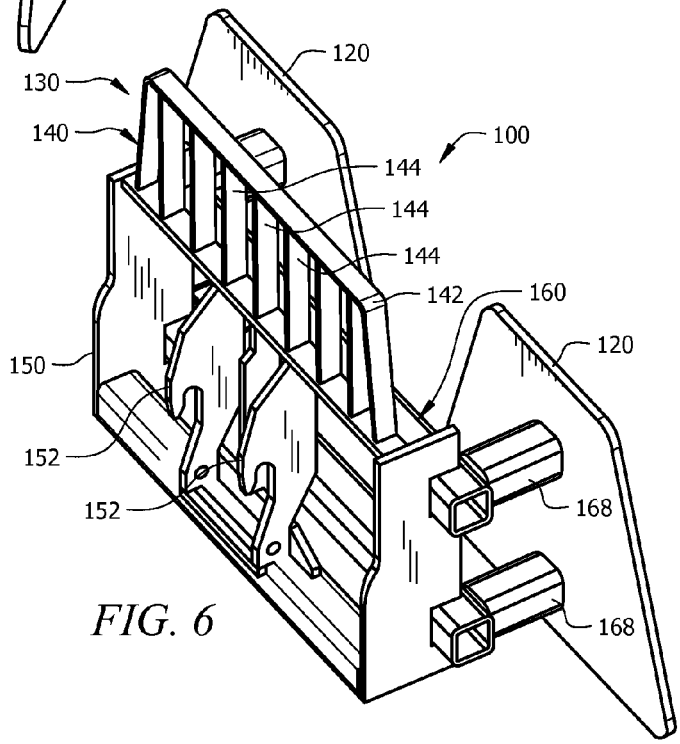
FIG. 6 is a rear view of the exemplary embodiment of the pivoting assembly for hoisting support receptacles of FIGS. 5A, 5B and 5C.

Referring to FIGS. 4-6, an exemplary embodiment of an assembly for hoisting support receptacles is illustrated in top, perspective and rear perspective views, and in three different pivot positions: neutral, pivoting to the left and pivoting to the right.

The exemplary assembly 100 shown has a pair of lifting plates 120 that are each shaped to receive a support receptacle 102. In this instance, the lifting plates 120 are trapezoidal, but may be any shape that has non-parallel converging sides that will engage the slots 108 of the support receptacles and thereby allow lifting of the support receptacles 102. In the case of the non-limiting trapezoidal example illustrated, the angle β between the lower of the two parallel sides and the non-parallel side may be less than 90° or in the range from about 60° to about 85°. Since the lifting plates and the support plates in this exemplary embodiment have matched geometry, the angle β, is best seen in FIG. 3.

The assembly 100 has a mounting bracket structure 130 for engaging a hoist to lift the support receptacles. As seen in FIG. 6, the illustrated example of a mounting bracket structure 130 has a substantially rectangular shaped upper frame 140. Upper frame 140 includes a surrounding frame 142 and an array of vertical supports 144, and is supported on lower frame structure 150. A pair of hooks 152, configured to engage with structure on the crane (not shown), extends rearward (i.e. away from the lifting plates 120) from the lower frame structure. Of course, structure, other than hooks 152 may be used, depending upon the hoist structure that must be engaged for lifting the assembly 100. The illustrated hooks 152 readily engage a coupling beam at the end of a Skycrane-type of quick connect that has a horizontal bar that fits within the hooks, and may then be secured to the hooks 152. The hydraulic controls of the crane can be used to raise, tilt and lower the assembly. Of course, other kinds of crane-coupling attachments may also be used, and the pivoting assembly is not limited to the exemplary hooks illustrated as crane-coupling devices.

Referring to the examples of FIGS. 4 and 5, lifting plates 120 are each mounted to a plate support structure 160 that has a rectangular frame 162, shown in this example as fabricated of tubular metal. The frame 162 has a pair of horizontally extending support beams 164, joined by a pair of vertically extending support beams 166. The lifting plates 120 are supported forward of the frame 162 and are attached to the frame 162 by couplers 168. Each of the couplers 168 may be welded to the frame 162 at one end and to the rear of its respective lifting plate 120 at the other end. Of course, support structure other than a rectangular frame may be used as well.

The lifting plate support structure 160 and the mounting bracket structure 130 are mechanically coupled together to pivot with respect to each other. In the example illustrated, a first bracket 170 extends rearward from the upper frame horizontal support beam 164, and a second bracket 170 (not shown in the views) extends rearward from the lower horizontal support beam. The brackets 170 have through holes that register, and that are sized and shaped to receive a pivot pin 176. Third bracket 174 and fourth bracket (not visible in views), similar to the first and second brackets 170, extend forward from the mounting bracket structure 130 to align with the first and second brackets such that through holes in the third bracket 174 and fourth brackets align with those of the first and second brackets 170. Thus, a pivot pin may extend through all four holes since these register with each other. The lifting plate support structure 160 can therefore pivot relative to the mounting bracket structure 130 about the pivot pin 176, which is the pivot point.

Figure 4B:
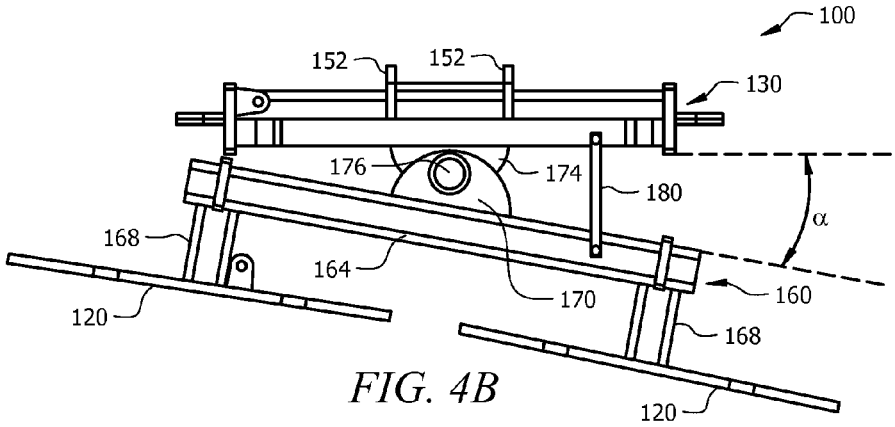
Figure 4C:
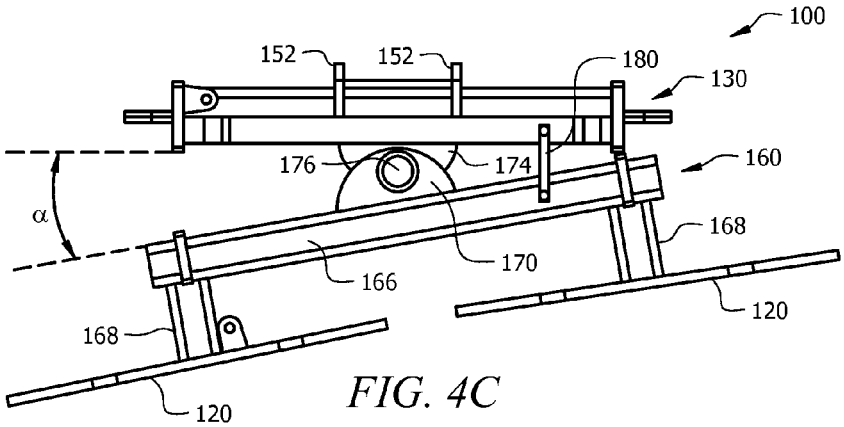

To facilitate the controlled pivoting of the lifting plate support structure 160 relative to the mounting bracket structure 130, a control device (not shown) may be used to control an extendable and retractable pivot arm, such as for example, a hydraulic or pneumatic cylinder or a servomechanism 180 that can extend and retract, thereby pivoting the lifting plate support structure 160 relative to the mounting bracket structure 130 at the pivot point, where the pivot pin is located. As shown in FIGS. 4B and 4C, the angular range of pivoting is through an angle $\alpha$. The angle $\alpha$ is not critical, but in an exemplary embodiment is sufficiently large to facilitate placement of the tank wall section on the assembly in close alignment with an adjacent tank wall section.

A pair of lifting lugs 190 shown in FIGS. 5A-C may be used to hoist the assembly 100 for transportation, or handling, or to couple it to the cooperating mechanical structure of a crane or hoist for use in lifting support receptacles.

In general, the wall sections are fabricated off-site in a machine-shop environment, and are very heavy. They are hoisted with cranes and stacked onto vehicles, like flat bed trucks, to be hauled to the site where the tank is to be constructed. On site the tank sections are readily lifted from the flat bed by using the tank wall section hoisting assembly, of which embodiments are described above. The assembly is attached to the end of a crane and may be tilted such that the plates are in an orientation suitable to slide into the support receptacles of the tank wall section. Typically, the plates would lie flat on the flat bed, so the plates would be tilted to a substantially horizontal orientation. Once the lifting plates are in the support plate slots, the assembly is raised and the plates are tilted to substantially vertical orientation, thereby lifting and tilting the tank wall section to the vertical. The tank wall section is then safely transported to any desired location, such as to on-site storage or to be added to the tank wall under construction.

At the tank wall construction site, each wall section is hoisted by a crane and guided into place next to other already installed wall sections. In order to join wall sections together it is necessary to get alignment between the wall sections and overlap of the wall edges. The tank wall section is manipulated at the end of a crane, for example, a Skycrane, so that when the tank wall section is in position, the operator pivots the assembly to bring the tank wall section into closer alignment with the end of the tank wall to which it should be coupled. Once satisfied that the tank wall section is sufficiently closely aligned for ready coupling to the tank wall, the operator sets the tank wall section down, and uses the crane end to move the assembly downward, thereby sliding the lifting plates out of the slots of the support receptacles. The operator can then repeat the process for the next tank wall section to be moved and aligned.

While at least one exemplary embodiment has been presented in the foregoing detailed description section, it should be appreciated that many variations exist. It should also be appreciated that the exemplary embodiments are only examples, and are not intended to limit the scope, applicability, or configuration of the claimed inventions in any way. Rather, the foregoing detailed description provides a convenient road map for those of ordinary skill in the art to implement exemplary embodiments. It should be understood that various changes can be made in the function and arrangement of elements described herein without departing from the scope of the patent claims listed below, including the legal equivalents of these patent claims.

The invention claimed is:

1. An assembly for hoisting an object having support receptacles attached to a surface thereof, the assembly comprising:

a mounting bracket configured to mechanically engage with a lifting end of a crane;

a structural frame extending forward from and pivotally coupled to the mounting bracket; and lifting plates each having opposed non-parallel sides, the opposed non-parallel sides of the lifting plates angled to slidingly engage the support receptacles during lifting of the support receptacles and the object to which they are attached, the lifting plates coupled to the structural frame such that in a first structural frame pivot position a first lifting plate is closest to the mounting bracket and in a second structural frame pivot position another lifting plate is closest to the mounting bracket.

2. The assembly of claim 1, further comprising a pivot arm pivoting the lifting plates, about a pivot point relative to the mounting bracket.

3. The assembly of claim 2, wherein the pivot arm is selected from the group consisting of a hydraulic cylinder, a pneumatic cylinder and a servomechanism.

4. The assembly of claim 3, further comprising a controller that controls a reciprocator to controllably pivot the lifting plates relative to the mounting bracket.

5. The assembly of claim 4, wherein the controller is manually controlled by input from an operator.

6. The assembly of claim 1, wherein the lifting plates are coplanar.

7. The assembly of claim 1, wherein the lifting plates comprise a pair of lifting plates, each of the pair of lifting plates located on an opposite side of a pivot point fixedly attached to the mounting bracket.

8. The assembly of claim 1, wherein the lifting plates have a trapezoidal shape comprising upper and lower parallel sides.

9. The assembly of claim 8, wherein the opposed non-parallel sides of the lifting plates are at an angle $\beta$, to the lower parallel side, where $\beta$ is from 60 to 85°.

10. The assembly of claim 1, wherein the structural frame pivots about a pivot point relative to the mounting bracket, thereby pivoting the lifting plates relative to the mounting bracket.

11. A method of using the assembly of claim 1, the method comprising:

sliding a first one of the lifting plates of the assembly into a slot of a first support receptacle attached to an object;

lifting the assembly, including the object attached to the support receptacles;

moving the lifted object to a predetermined position;

aligning the object by pivoting the lifting plates of the assembly;

lowering the aligned object into an aligned position; and separating the first lifting plate from the first support receptacle by sliding the first lifting plate out of the slot of the first support receptacle.

12. The method of claim 11, wherein the step of pivoting further comprises pivoting a second one of the lifting plates.

13. An assembly for hoisting an object having a curved surface and having support receptacles attached to the curved surface, the assembly comprising:

a mounting bracket configured to mechanically engage with a lifting end of a crane;

a structural frame pivotally coupled to the mounting bracket at a pivot point, the structural frame having a plate-supporting beam extending to opposite sides of the pivot point; and a pair of lifting plates each having opposed non-parallel sides, the opposed non-parallel sides of the lifting plates angled to engage the support receptacles to lift the support receptacles and the attached object, the pair of lifting plates each mechanically coupled to the plate-supporting beam on opposite sides of the pivot point, the structural frame pivoting from a first position wherein a first lifting plate of the pair is closest to the mounting bracket to a second position wherein a second plate of the pair is closest to the mounting bracket.

14. The assembly of claim 13, further comprising a pivot arm controllably pivoting the structural frame about the pivot point relative to the mounting bracket.

15. The assembly of claim 14, wherein the pivot arm is selected from the group consisting of a hydraulic cylinder, a pneumatic cylinder and a servomechanism.

16. The assembly of claim 15, further comprising a controller that controls a reciprocator to controllably pivot the structural frame relative to the mounting bracket.

17. The assembly of claim 16, wherein the controller is manually controlled by input from an operator.

18. The assembly of claim 13, wherein the coplanar lifting plates have a trapezoidal shape comprising upper and lower parallel sides.

19. The assembly of claim 18, wherein the opposed non-parallel sides of the lifting plates are at an angle $\beta$, to the lower parallel side, where $\beta$ is from 60 to 85°.

* * * * *

UNITED STATES PATENT AND TRADEMARK OFFICE

CERTIFICATE OF CORRECTION

PATENT NO. : 8,474,892 B1
APPLICATION NO. : 13/495818
DATED : July 2, 2013
INVENTOR(S) : Matthew Hanna It is certified that error appears in the above-identified patent and that said Letters Patent is hereby corrected as shown below:

In the Specification:
Column 2, Line 45, delete “the” before --lift--.
Column 2, Line 45, insert --the-- before --tank--.

Column 3, Line 40, delete “much” and insert --must--.
Column 3, Line 61, delete “the” after --already-installed--.

In the Claims:
Column 8, Line 14, Claim 18, delete “coplanar” before --lifting--.

Signed and Sealed this
Twelfth Day of November, 2013

Teresa Stanek Rea

Teresa Stanek Rea
*Deputy Director of the United States Patent and Trademark Office*